United States Patent [19]

Michael

[11] 4,258,289

[45] Mar. 24, 1981

[54] METAL HALIDE LAMP FOR OPERATION WITH A MERCURY BALLAST

[75] Inventor: Jacob F. Michael, Paramus, N.J.

[73] Assignee: Westinghouse Electric Corp., Pittsburgh, Pa.

[21] Appl. No.: 37,583

[22] Filed: May 9, 1979

[51] Int. Cl.[3] ..... H01J 7/44; H01J 17/34; H01J 19/78; H01J 29/96

[52] U.S. Cl. ..... 315/60; 315/DIG. 5; 315/73; 315/234; 315/264

[58] Field of Search ..... 315/60, 73, DIG. 5, 315/DIG. 1, 234, 264, 263, 234

[56] References Cited

U.S. PATENT DOCUMENTS

| | | | |
|---|---|---|---|
| 3,226,597 | 12/1965 | Green | 315/60 |
| 3,445,721 | 5/1969 | Waymouth | 315/60 |
| 3,619,710 | 11/1971 | Waymouth | 315/47 |
| 3,619,711 | 11/1971 | Freese, Jr. | 315/60 |
| 3,715,622 | 2/1973 | Page et al. | 315/60 |
| 3,900,761 | 8/1975 | Freese et al. | 315/60 |
| 3,982,154 | 9/1976 | Mize et al. | 315/234 |
| 4,007,397 | 2/1977 | Lake | 315/60 |
| 4,064,416 | 12/1977 | Krense et al. | 315/60 |
| 4,097,777 | 6/1978 | Bacharowski | 315/60 |

*Primary Examiner*—Saxfield Chatmon, Jr.
*Attorney, Agent, or Firm*—R. S. Lombard

[57] ABSTRACT

A metal halide high-intensity discharge lamp for connection to a constant wattage-type ballast including a transformer with a secondary having a capacitor connected in series circuit arrangement therewith. The lamp includes starting aid means including a voltage doubler comprising a diode and two resistors operating in conjunction with the ballast capacitor. The starting aid means further comprises a normally closed heat-responsive switch means operative to prevent voltage stress on the diode after the lamp starts.

3 Claims, 2 Drawing Figures

METAL HALIDE LAMP FOR OPERATION WITH A MERCURY BALLAST

CROSS-REFERENCE TO RELATED APPLICATION

In copending application Ser. No. 037,583, filed concurrently herewith by J. F. Michael and D. A. Larson, and owned by the present assignee, is disclosed a metal halide lamp which operates on a constant-wattage-type mercury lamp ballast. The lamp includes starting aid means for initial starting of the lamp and warm-up assistance means to maintain the discharge during lamp warm-up.

BACKGROUND OF THE INVENTION

This invention relates to metal halide high-intensity discharae lamps, and more particularly, to metal halide lamps operable from a constant wattage-type mercury ballast.

A metal halide lamp that may be started on a high pressure mercury vapor lamp ballast is disclosed in U.S. Pat. No. 3,900,761 dated Aug. 19, 1975 issued to Freese et al. A resistor and a diode are connected between the starter electrode and the adjacent main electrode and a second resistor is connected in circuit between the starter electrode and its connector to an external power supply.

A high-intensity discharge lamp utilizing a starter electrode voltage doubling circuit is disclosed in U.S. Pat. No. 3,982,154 dated Sept. 21, 1976, issued to Mize et al. The voltage doubling circuit comprises a diode and a mica-dielectric capacitor which is electrically interposed between an inlead into the jacket and the frame side rod and forms an integral structural part of the frame and supports the arc tube. The starter electrode is resistively connected to the side rod to facilitate starting and the arrangement maintains a positive DC bias on the frame which reduces electrolysis of sodium through the arc tube walls.

An arc discharge lamp designed to prevent electrolysis is disclosed in U.S. Pat. No. 3,619,711 dated Nov. 9, 1971 issued to Robert W. Freese, Jr. The arc tube of the discharge lamp has two main electrodes and a starter electrode adjacent one of them, the starting electrode being electrically connected to the adjacent electrode through a rectifying device, such as a diode, external of the arc tube. The polarity of the rectifier is such as to permit the starter electrode to obtain a voltage positive with respect to the adjacent electrode, but to substantially prevent negative voltage therebetween.

Another discharge lamp designed to prevent electrolysis is disclosed in U.S. Pat. No. 3,619,710 dated Nov. 9, 1971 issued to John F. Waymouth. This patent discloses that the starter electrode is electrically connected to the other main electrode through a thermally operative switch and a second resistor. In normal operation, the switch opens after lamp ignition to isolate the starter electrode from the circuit of the other main electrode to place the starter electrode at substantially the same potential as the adjacent main electrode.

SUMMARY OF THE INVENTION

This invention provides for a metal halide high-intensity discharge lamp for connection to a constant wattage-type mercury ballast, including a transformer having a primary and a secondary, the secondary having a capacitor means in series circuit arrangement therewith.

The lamp comprises an elongated radiation-transmitting arc tube which is enclosed by and supported within a light-transmitting protective outer envelope. The arc tube encloses a discharge sustaining filling and has operating electrodes operatively positioned therein proximate the ends thereof and a starting electrode positioned in close proximity to one of the operating electrodes. Electrical lead-in means are sealed through the arc tube and connected to the electrodes. The electrical adaptor means are affixed to the outer surface of the protective envelope to facilitate electrical connection of the lamp to a source of electrical power. The electrical adaptor means comprise a metallic shell portion and a metallic eyelet separated by an electrical insulating means. Elongated conductor means electrically connect the other operating electrode to the shell portion.

Starting aid means is positioned within the protective envelope comprising diode means connected in circuit between the one operating electrode and the starting electrode. The starting aid means also comprises first resistor means connected in circuit between the starting electrode and the diode means, and second resistor means connected in circuit between the diode means and the elongated conductor means. The lamp described thus far is conventional.

The improvement comprises a normally closed temperature responsive switch means connected in circuit between the second resistor means and the elongated conductor means and positioned in close proximity to the arc tube to cause the switch means to open when the switch means is heated by the arc tube during normal lamp operation. As a result, after the lamp is normally operating, the heat sensitive switch means opens and disconnects the starting aid means to prevent voltage stress of the diode means and cause the starting electrode and the operating electrode to be at substantially the same potential.

BRIEF DESCRIPTION OF THE DRAWINGS

For a better understanding of the invention, reference may be made to the accompanying drawings, in which.

DESCRIPTION OF THE PREFERRED EMBODIMENTS

Figure 1:
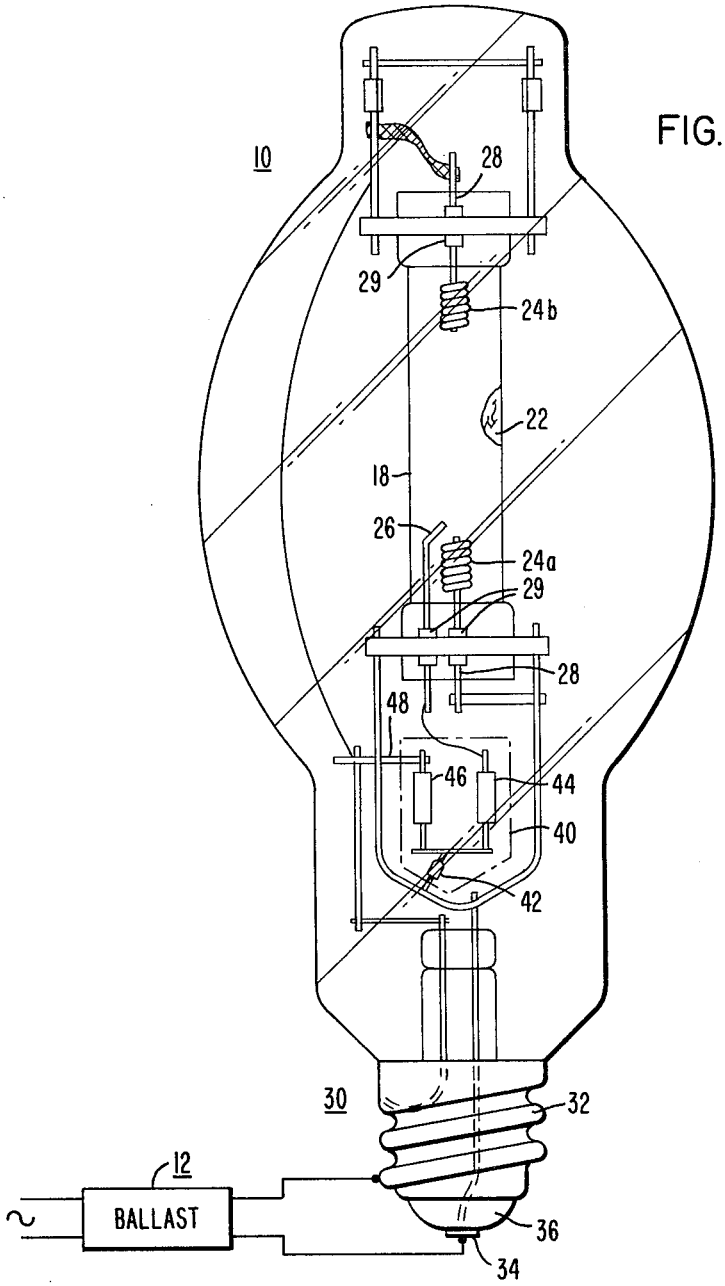
FIG. 1 is an elevational of a metal halide high-intensity discharge lamp embodying the invention; and, FIG. 2 is a schematic diagram of the lamp circuit and a typical constant wattage ballast circuit.
Figure 2:
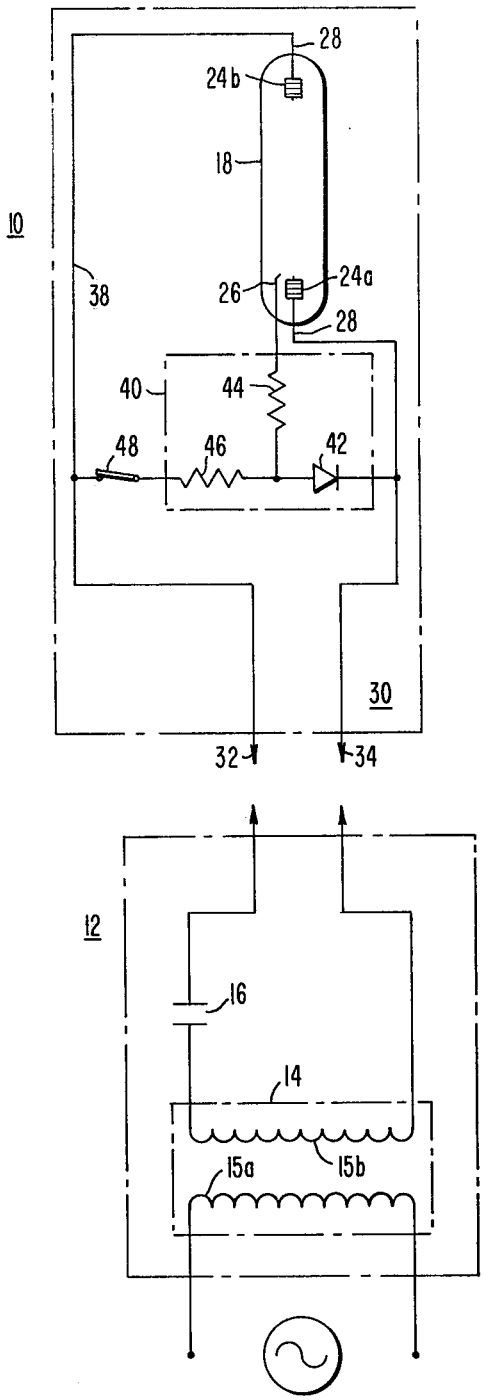

With reference to FIGS. 1 and 2, there is shown a metal halide high-intensity discharge lamp 10 for connection to a constant wattage-type ballast 12 which typically comprises a transformer 14 having two separate windings, primary 15*a* and secondary 15*b*, as shown in FIG. 2 or, alternatively, an autotransformer. In addition, the ballast 12 includes a capacitor 16 in series circuit arrangement with secondary 15*b* of the transformer 14. The primary 15*a* of the transformer 14 is connected to a source of electrical power.

The lamp 10 comprises an elongated radiation-transmitting arc tube 18 which is enclosed by and supported within a light-transmitting protective outer envelope 20. The arc tube 18 encloses a discharge sustaining filling 22 containing mercury and one or more metal halides, typically sodium iodide and scandium iodide, as is well known in the art. The arc tube 18 has operating electrodes 24*a*, 24*b*, which may be prepared of a suitable electrode material such as tungsten. The operating electrodes 24*a*, 24*b* are operatively positioned within the arc tube 18 proximate the ends thereof. The starting electrode 26 is positioned in close proximity to one of the operating electrodes 24*a*. Electrical lead-in means 28 include ribbon-type molybdenum seals 29 which are sealed through the arc tube. The lead-in means 28 are connected to the operating electrodes 24*a*, 24*b*.

The electrical adaptor means 30 comprises a metallic shell portion 32 and a metallic eyelet 34 separated by an electrical insulating means 36 such as a glass insulator. Elongated conductor means 38 electrically connect the other operating electrode 24*b* to the shell portion 32.

Starting aid means 40, which is included so that metal halide lamp 10 may be started on the mercury ballast 12, is positioned within the outer envelope 20 as shown in FIG. 1. The starting aid means 40 comprises diode means 42 connected in circuit between the one operating electrode 24*a* and the starting electrode 26. First resistor means 44 is connected in circuit between the starting electrode 26 and the diode means 42 and second resistor means 46 is connected in circuit between the diode means 42 and the elongated conductor means 38. The starting aid means 40 as described, functions as a voltage doubler during starting of the lamp 10. The capacitor 16 charges during one half cycle through second resistor 46 and discharges in the next half cycle through first resistor 44 and second resistor 46. During discharge of capacitor 16 the capacitor voltage adds to the voltage across the secondary of the transformer. The lamp 10 as described to this point is generally conventional.

The improvement comprises a normally closed temperature responsive switch means 48 connected in circuit between the second resistor means 46 and the elongated conductor means 38 and positioned in close proximity to the arc tube 18 to cause the switch means 48 to open when the switch means is heated by the arc tube 18 during normal lamp operation. The temperature responsive switch means 48 may be a bimetallic switch, for example. After the lamp 10 is normally operating, the temperature responsive switch means 48 opens and disconnects the starting aid means 40 to prevent voltage stress of the diode means 42.

A 400 watt metal halide high-intensity discharge lamp was prepared in accordance with this invention utilizing the following components for the starting aid means 40 and the temperature responsive switch means 48:

(a) General Instrument Diode #IN5061;

(b) 2–40,000 Ω resistors; and, (c) Bimetal switch 0.008″×0.125″ Truflex B-1 cleaned and baked.

The bimetal switch is positioned within about 25 centimeters of the arc tube. This results in the starting aid means 40 being disconnected normally in about 0.5 minutes. The temperature responsive switch means 48 prevents the diode means from experiencing the voltage stress resulting from the approximately 200° C. temperature near the arc tube 18.

I claim:

1. In combination with a metal halide high-intensity discharge lamp for connection to a constant wattage-type mercury ballast, including a transformer having a primary and a secondary, said secondary having a capacitor means in series circuit arrangement therewith, said lamp comprising:

an elongated radiation-transmitting arc tube which is enclosed by and supported within a light-transmitting protective outer envelope, said arc tube enclosing a discharge-sustaining filling and having operating electrodes operatively positioned therein proximate the ends thereof and a starting electrode positioned in close proximity to one of said operating electrodes, electrical lead-in means sealed through said arc tube and connected to said operating electrodes, electrical adaptor means affixed to the outer surface of said protective envelope to facilitate electrical connection of said lamp to a source of electrical power, said electrical adaptor means comprising a metallic shell portion and a metallic eyelet separated by an electrical insulating means, elongated conductor means electrically connecting said other operating electrode to said shell portion, starting aid means positioned within said outer envelope comprising diode means connected in circuit between said one operating electrode and said starting electrode, first resistor means connected in circuit between said starting electrode and said diode means and second resistor means connected in circuit between said diode means and said elongated conductor means, the improvement which comprises:

normally closed temperature responsive switch means connected in circuit between said second resistor means and said elongated conductor means and positioned in close proximity to said arc tube to cause said switch means to open when said switch means is heated by said arc tube during normal lamp operation, whereby after said lamp is normally operating, said temperature responsive switch means opens and disconnects said starting aid means to prevent voltage stress of said diode means thereby minimizing electrolysis of said electrical lead-in means.

2. The lamp of claim 1, wherein said normally closed temperature responsive switch means is a bimetallic switch.

3. The lamp of claim 1, wherein said electrical lead-in means include ribbon-type molybdenum seals.

* * * * *